US006912871B2

(12) United States Patent
Lee et al.

(10) Patent No.: US 6,912,871 B2
(45) Date of Patent: Jul. 5, 2005

(54) STRUCTURE FOR REDUCING REFRIGERANT FLOW LOSS IN COMPRESSOR

(75) Inventors: Chang-Soo Lee, Gimhae (KR); Sog-Kie Hong, Changwon (KR)

(73) Assignee: LG Electronics Inc., Seoul (KR)

( * ) Notice: Subject to any disclaimer, the term of this patent is extended or adjusted under 35 U.S.C. 154(b) by 130 days.

(21) Appl. No.: 10/380,515

(22) PCT Filed: Dec. 27, 2002

(86) PCT No.: PCT/KR02/02457

§ 371 (c)(1),
(2), (4) Date: Mar. 14, 2003

(87) PCT Pub. No.: WO03/089793

PCT Pub. Date: Oct. 30, 2003

(65) Prior Publication Data

US 2004/0123623 A1 Jul. 1, 2004

(30) Foreign Application Priority Data

Apr. 16, 2002 (KR) ..... 2002-0020689

(51) Int. Cl.[7] ..... F25B 1/00; F01C 1/10; F04B 17/00

(52) U.S. Cl. ..... 62/498; 418/216; 418/55.2; 417/317

(58) Field of Search ..... 62/498; 418/216, 418/55.2, 55.1; 417/317, 371

(56) References Cited

U.S. PATENT DOCUMENTS 4,730,998 A * 3/1988 Kakuda et al. ..... 418/55.1

FOREIGN PATENT DOCUMENTS

JP 63208689 A * 8/1988 ..... F04C/23/02

* cited by examiner

*Primary Examiner*—Chen Wen Jiang
(74) *Attorney, Agent, or Firm*—Fleshner & Kim, LLP

(57) ABSTRACT

A structure for reducing a refrigerant flow loss in a compressor includes a refrigerant flow resistance reducing unit to reduce a refrigerant channel resistance at a lower surface of a rotor facing a compression mechanism unit. When the high temperature and high pressure refrigerant gas discharged from the compression mechanism unit flows to the discharge pipe through the refrigerant passage including the gap between the rotor and the stator of the electric mechanism unit, the flow resistance of the refrigerant gas is reduced. Therefore, since the refrigerant can flow smoothly, a flow loss of the refrigerant can be reduced and, as a noise generation is reduced, a reliability can be heightened.

19 Claims, 7 Drawing Sheets

STRUCTURE FOR REDUCING REFRIGERANT FLOW LOSS IN COMPRESSOR

TECHNICAL FIELD

The present invention relates to a structure for reducing a refrigerant flow loss of a compressor and, more particularly, to a structure for reducing a flow loss of a compressor that is capable of minimizing a flow loss of a refrigerant gas generated during a process in which a high temperature and high pressure refrigerant gas discharged from a compression mechanism unit flows to a discharge pipe.

BACKGROUND ART

In general, a compressor is a device for compressing a fluid, consisting of a hermetic container having an inner space, an electric mechanism unit mounted in the hermetic container and generating a driving force, and a compression mechanism unit compressing a gas upon receiving the driving force.

The compressor is generally classified into a rotary compressor, a reciprocating compressor, a scroll compressor, or the like, according to a type of the compression mechanism unit which compresses a gas.

As shown in FIGS. 1, 2 and 3, the compressor includes the electric mechanism unit consisting of a stator 2 fixedly coupled at one inner side of the hermetic container 1 and a rotor 3 inserted into the stator 2.

The stator 2 is made by winding a winding coil 2*b* at a stacking body 2*a* in an annular bar form with a certain length, and fixedly coupled at an inner wall of the hermetic container 1. At this time, a gas passage in which a refrigerant gas flows is formed between the inner wall of the hermetic container 1 and an outer circumferential surface of the stator 2.

The rotor 3 is formed in an annular bar form with a predetermined length and insertedly coupled inside the stator 2 with a certain space therebetween.

A discharge pipe 4 is coupled at one side of the hermetic container 1 so as to be positioned at an upper side (in view of drawing) of the stator 2 and the rotor 3.

The compression mechanism unit includes a cylinder assembly (D) having an inner space (V), a suction passage (f1) and a discharge passage (f2) communicating with the inner space and fixedly coupled at an inner wall of the hermetic container 1 spaced apart from the electric mechanism unit, and a rotational shaft 20 coupled to penetrating the center of the inner space (V) of the cylinder assembly (D).

One side of the rotational shaft 20 is press-fit to the rotor 3 of the electric mechanism unit.

The cylinder assembly (D) includes a cylinder 30 having a through hole, and an upper bearing plate 40 and a lower bearing plate 50, respectively, coupled to cover an upper surface and a lower surface of the cylinder 30 to thereby form the inner space (V) together with the cylinder 30 and supporting the rotational shaft 20.

The rotational shaft 20 includes an axial portion 21 with a predetermined outer diameter and length inserted into axial insertion holes 43 and 53 respectively formed at the upper bearing plate 40 and the lower bearing plate 50, and a dividing plate 22 extendedly formed at one side of the axial portion 21 to section the inner space (V) of the cylinder assembly (D) into first and second spaces V1 and V2.

The dividing plate 22 of the rotational shaft 20, formed as a wave curved surface in a sine wave shape, includes an upper convex curved portion r1 formed with a convex surface in view of side section, a lower concave curved portion r2 formed with a concave surface, and a connection curved portion r3 connecting the convex curved portion r1 and the concave curved portion r2.

A vane 70 is inserted into a vane slot 44 formed at one side of the upper bearing plate 40 and a vane slot 54 formed at one side of the lower bearing plate 50, and an elastic support unit 80 supporting the vane 70 is coupled at the upper bearing plate 40 and the lower bearing plate 50.

An opening and closing unit 90 is coupled at the cylinder assembly (D) to discharge a gas compressed in the compression areas $V1_b$ and $V2_b$ of the first and second spaces V1 and V2 by opening and closing the discharge passage f2, and a suction pipe 100 is coupled to the hermetic container 10 in a manner of communicating with the suction passage f1.

Reference numeral 110 denotes a noise muffler.

The operation of the compressor will now be described.

First, when power is applied to the electric mechanism unit (M), the rotor 3 is rotated by the interaction between the stator 2 and the rotor 3 of the electric mechanism unit. The rotational force of the rotor 3 is transferred to the rotational shaft 20 coupled at the rotor 3 and the rotational shaft 20 is rotated. Then, the dividing plate 22 of the rotational shaft 20 is rotated in the inner space (V) of the cylinder assembly (D).

As the dividing plate 22 of the rotational shaft 20 is rotated in the inner space (V) of the cylinder assembly (D), vanes 70 being in contact with the dividing plate 22 interwork to change the first space V1 and the second space V2 to suction areas V1*a* and V2*a* and compression areas V1*b* and V2*b*, and with the opening and closing unit 90 operating, a refrigerant gas is sucked into the first and second spaces V1 and V2, compressed and discharged. This process is repeatedly performed.

The high temperature and high pressure refrigerant gas discharged from the compression mechanism unit into the hermetic container flows to the gap (G) between the rotor 3 and the stator 2 and the gas passage formed between an outer circumferential surface of the stator 2 and an inner circumferential surface of the hermetic container 1 and is discharged outwardly of the hermetic container 1 through the discharge pipe 4.

However, as for the compressor with such a structure, since the lower surface of the rotor 3 of the electric mechanism unit positioned at the upper side of the compression mechanism unit is formed plane, it is at a right angle to the outer circumferential surface of the rotational shaft 20 press-fit to the rotor 3. Thus, as shown in FIG. 4, in the process that the high temperature and high pressure refrigerant gas discharged from the compression mechanism unit flows to the gap (G) between the stator 2 and the rotor 3, the flowing of the refrigerant gas is not smoothly made and a flowing resistance occurs, resulting in that a flow channel loss and a noise are made.

DISCLOSURE OF THE INVENTION

Therefore, an object of the present invention is to provide a structure for reducing a refrigerant flow loss in a compressor that is capable of minimizing a flow loss of a refrigerant gas in its occurrence in the process that a high temperature and high pressure refrigerant gas discharged from a compression mechanism unit flows to a discharge pipe.

To achieve these and other advantages and in accordance with the purpose of the present invention, as embodied and broadly described herein, there is provided a structure for reducing a refrigerant flow loss in a compressor which includes an electric mechanism unit consisting of a stator fixedly coupled inside a hermetic container and a rotor rotatably inserted into the stator with a certain space therebetween, and a compression mechanism unit having a rotational shaft coupled at the rotor of the electric mechanism unit and sucking, compressing and discharge a gas upon receiving a driving force of the electric mechanism unit, said structure further includes a refrigerant flow resistance reducing unit for reducing a refrigerant channel resistance formed at a lower surface of the rotor facing the compression mechanism unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Figure 1:
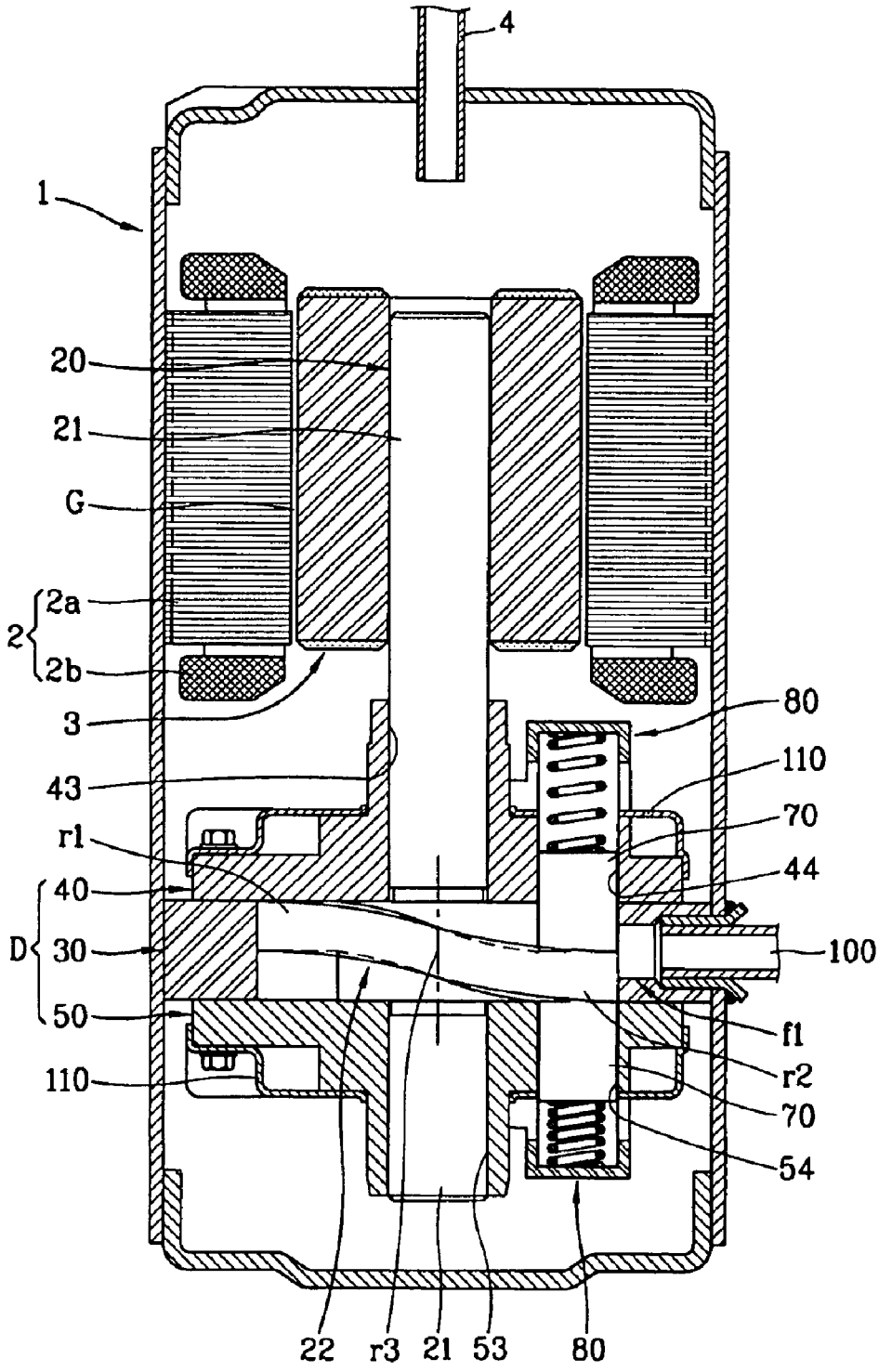
FIG. 1 CONVENTIONAL ART
FIG. 1 is a front sectional view of a compressor in accordance with a conventional art.
Figure 2:
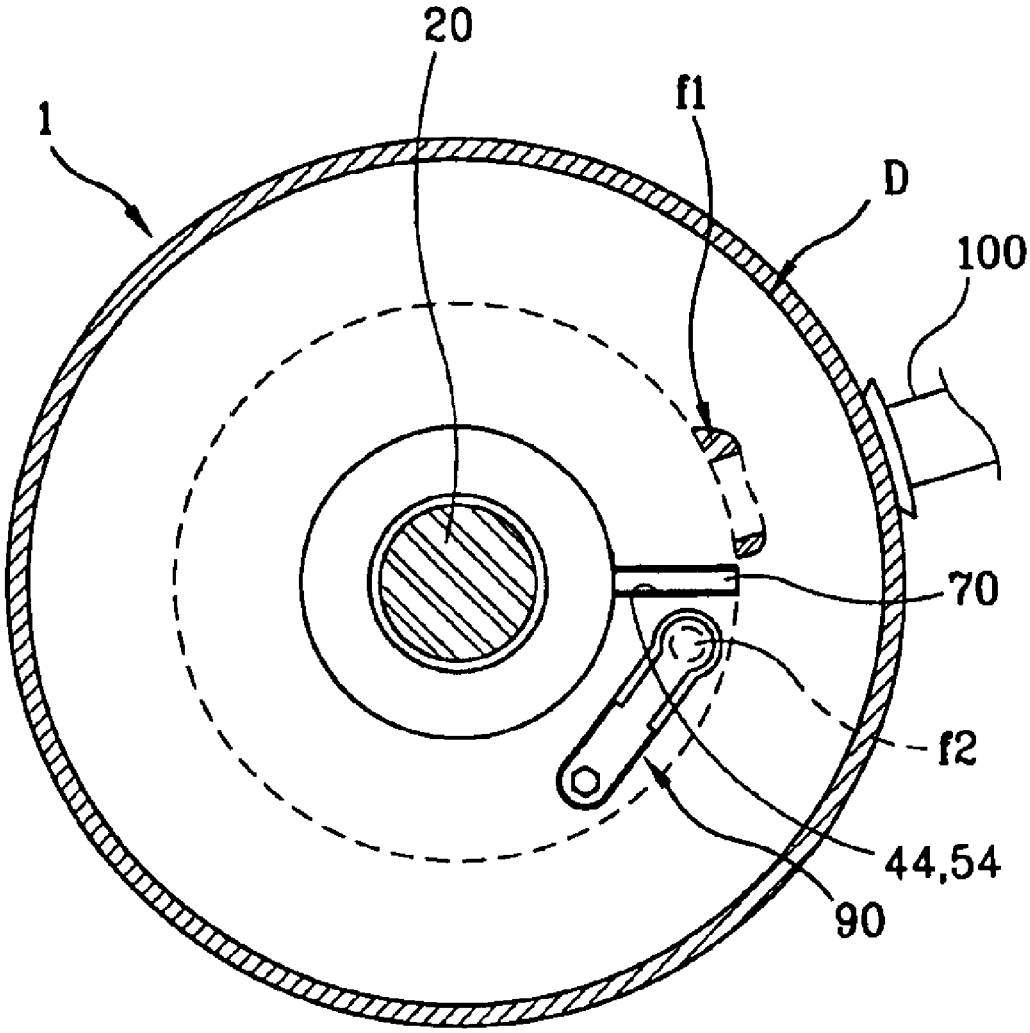
FIG. 2 CONVENTIONAL ART
FIG. 2 is a plan view of the compressor in accordance with the conventional art.
Figure 3:
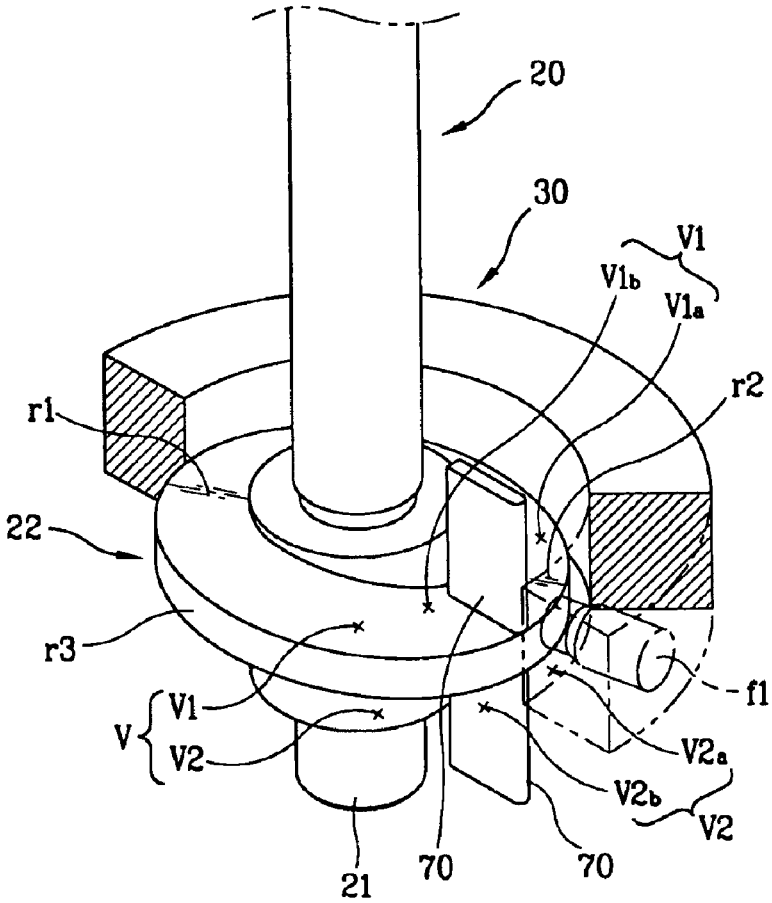
FIG. 3 CONVENTIONAL ART
FIG. 3 is a perspective view of a compression mechanism unit of the compressor in accordance with the conventional art.
Figure 4:
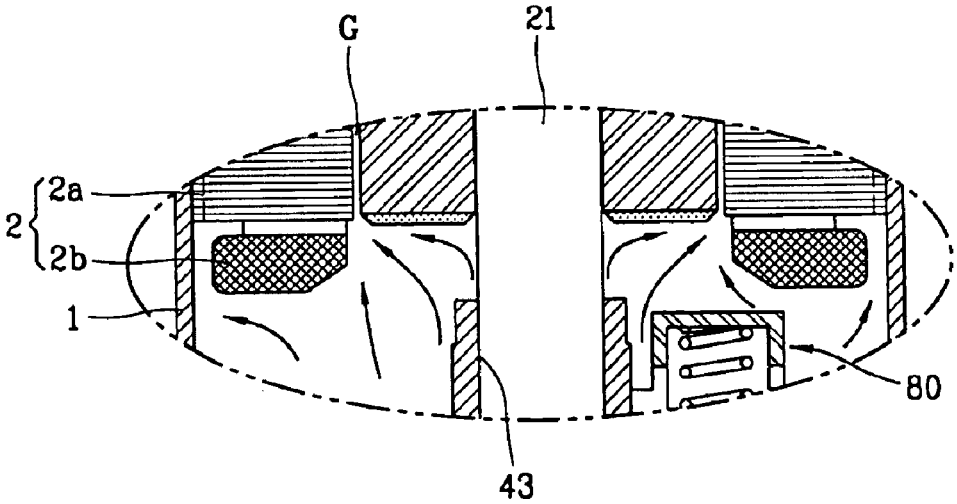
FIG. 4 CONVENTIONAL ART
FIG. 4 is a partial plan view showing a gas discharge state of the compressor in accordance with the conventional art.
Figure 5:
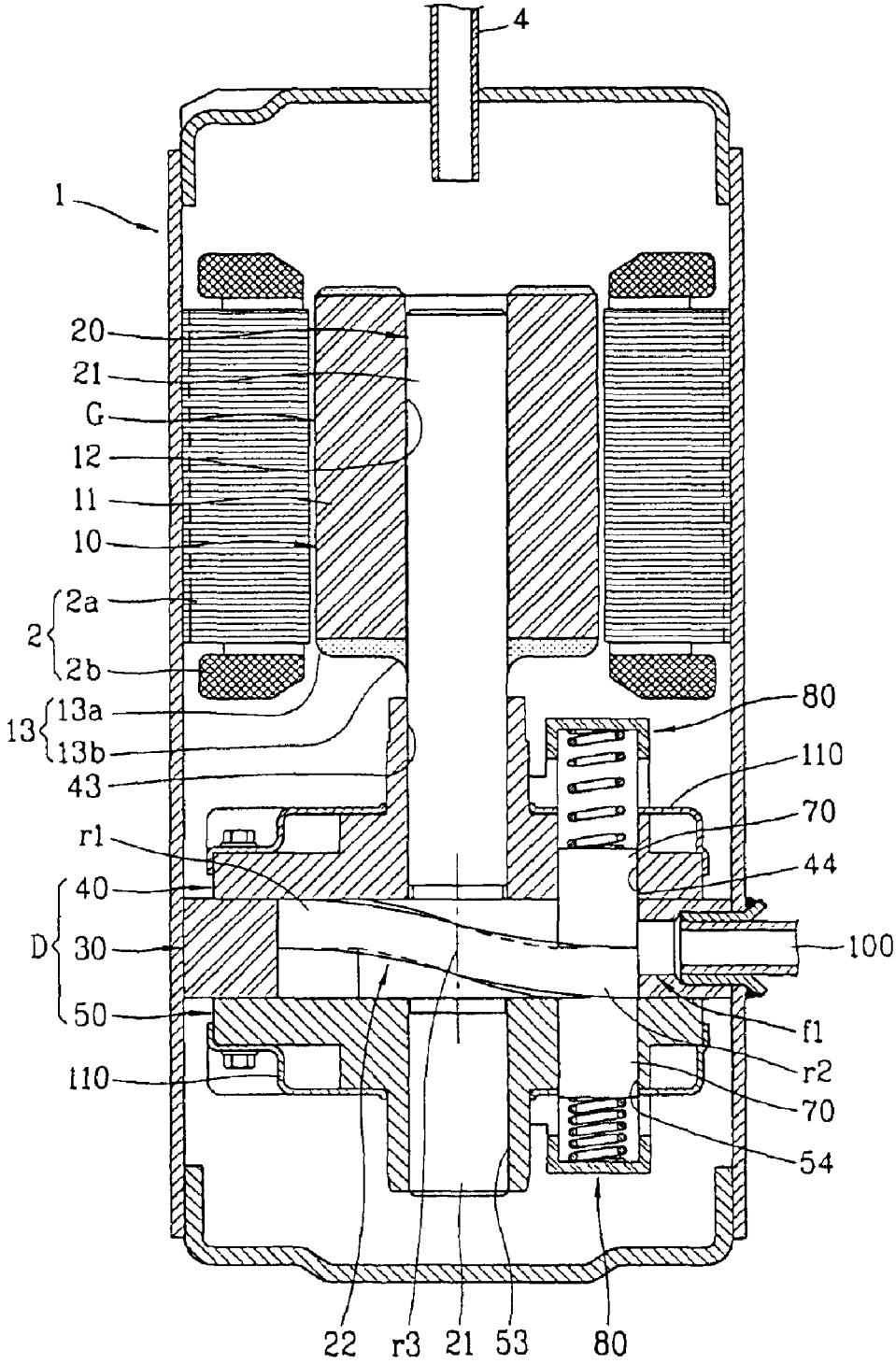
FIG. 5 is a front sectional view of a compressor adopting a refrigerant flow loss reducing structure in accordance with one embodiment of the present invention.
Figure 6:
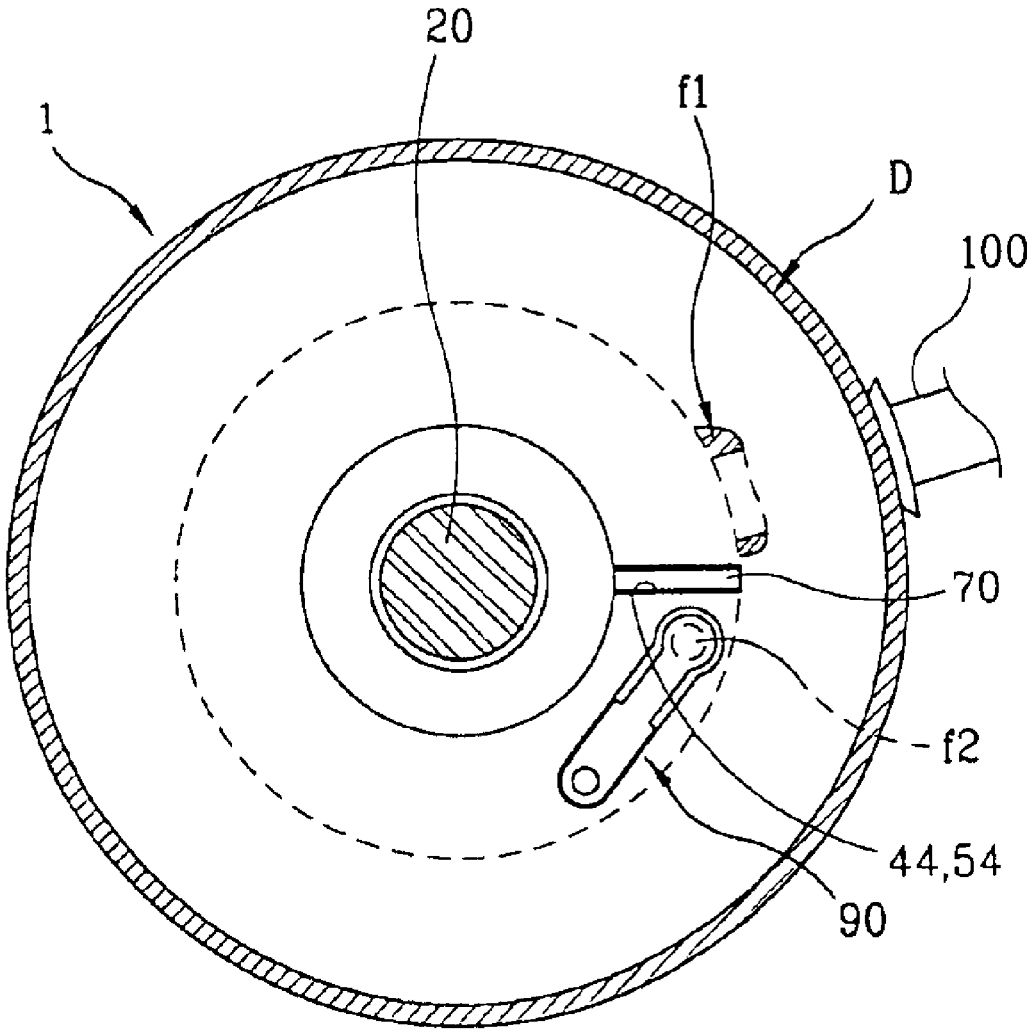
FIG. 6 is a plan view of the compressor adopting a refrigerant flow loss reducing structure in accordance with one embodiment of the present invention.
Figure 7:
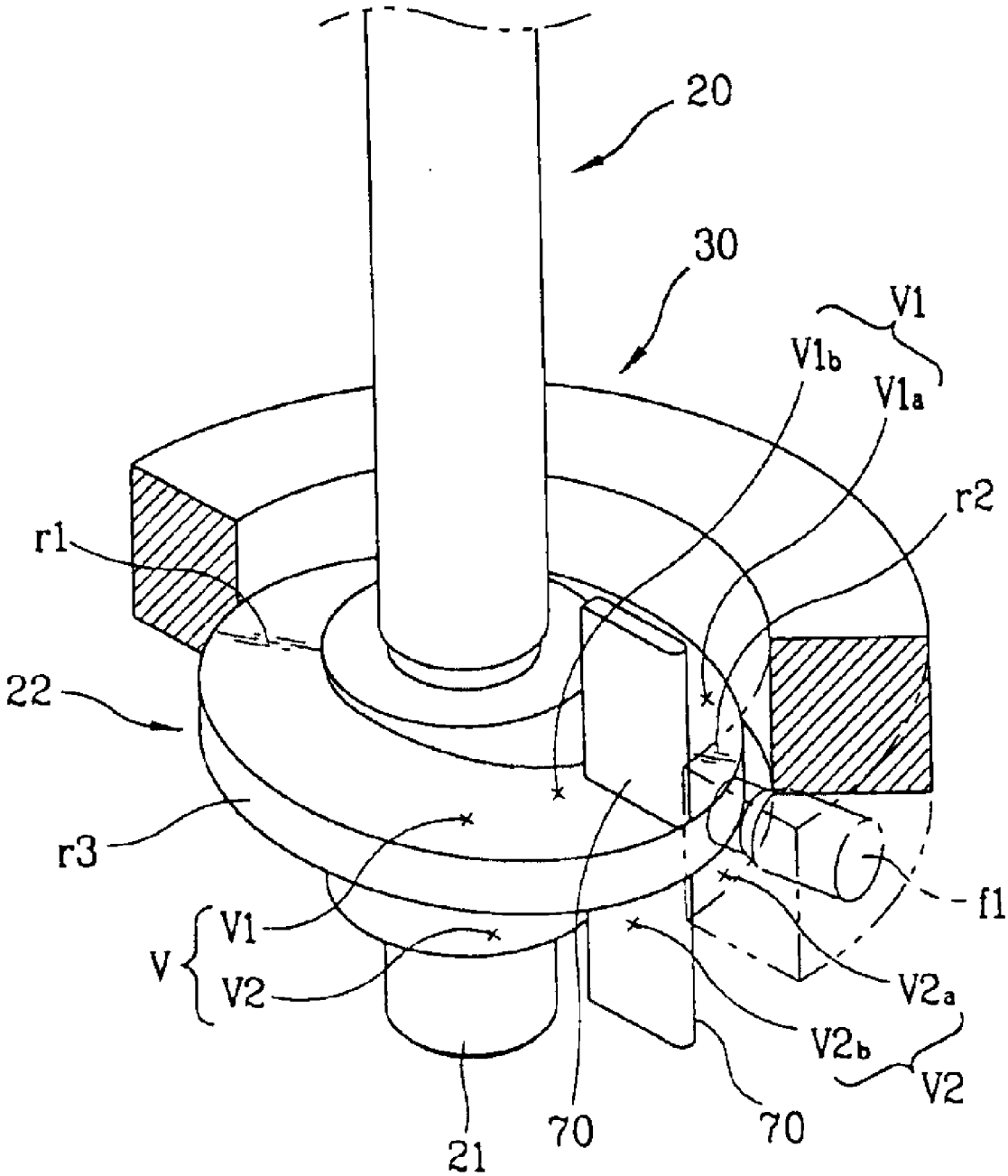
FIG. 7 is a partial perspective view of a compression mechanism unit of the compressor adopting a refrigerant flow loss reducing structure in accordance with one embodiment of the present invention.

FIGS. 5, 6 and 7 show a compressor adopting a refrigerant flow loss reducing structure.

As shown in FIGS. 5, 6 and 7, a compressor of the present invention includes an electric mechanism unit mounted at one inner side of a hermetic container 1 and generating a driving force and a compression mechanism unit for compressing a refrigerant gas upon receiving the driving force of the electric mechanism unit.

The electric mechanism unit includes a stator 2 fixedly coupled at one inner side of the hermetic container 1 and a rotor 10 rotatably inserted into the stator 2.

The stator 2 is formed by winding a winding coil 2*b* at a stacking body 2*a* in an annular bar form with a through hole and fixedly coupled at an inner wall of the hermetic container 1.

A gas passage is formed between the inner wall of the hermetic container 1 and an outer circumferential surface of the stator 2, in which the refrigerant gas flows.

The rotor 10 includes an axial coupling hole 12 with a predetermined inner diameter penetratingly formed inside an annular bar body 11 with a predetermined length, and a refrigerant flow resistance reducing unit 13 for reducing a refrigerant channel resistance formed at one side of the annular bar body 11.

The rotor 10 is rotatably inserted into the through hole of the stator 2 with a certain space therebetween.

The refrigerant flow resistance reducing unit 13 of the rotor 10 includes an edge convex curved surface 13*a* formed curved at an edge of the annular bar body 11 and an inner concave curved surface 13*b* formed concave at an outer surface extended from the edge of the axial coupling hole 12 of the annular bar body 11.

Figure 8:
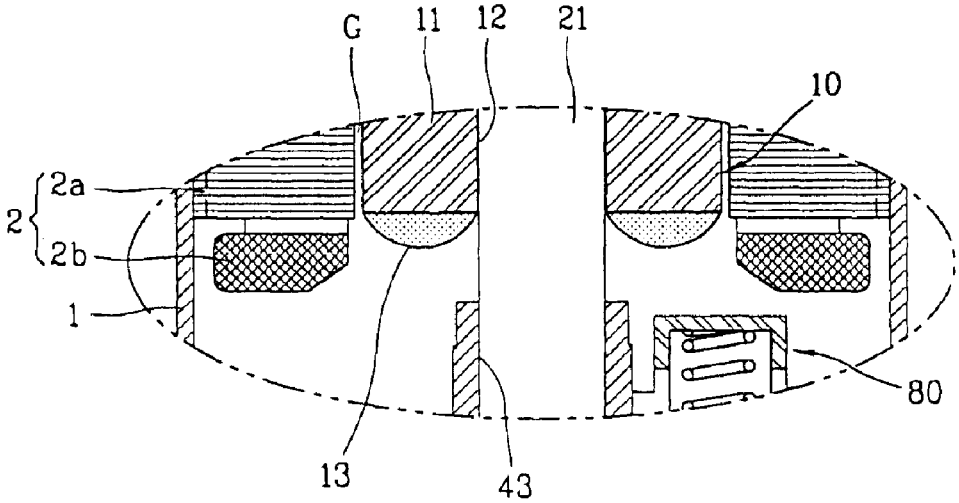
FIG. 8 is a sectional view of a refrigerant flow loss reducing structure of a compressor in accordance with another embodiment of the present invention.
Figure 9:
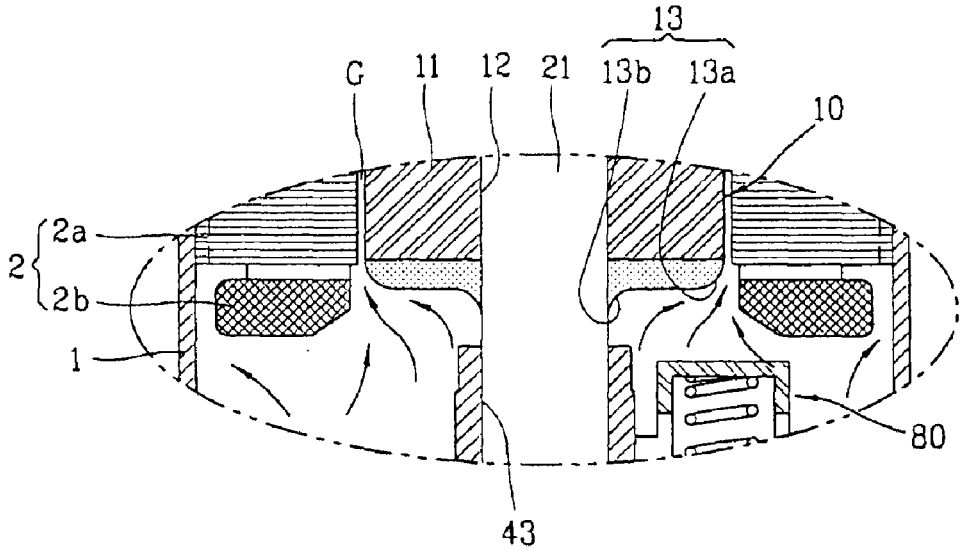
FIG. 9 is a partial sectional view showing a refrigerant gas flowing in the refrigerant flow loss reducing structure of FIG. 7.

As a modification of the refrigerant flow resistance reducing unit 13, as shown in FIG. 8, a refrigerant foxy resistance reducing unit 13 has a convex curved surface form so as to connect the edge line of the annular bar body 11 of the rotor 10 and the edge line of the axial coupling hole 12 formed penetrating the center of the annular bar body 11 of the rotor 10.

The refrigerant flow resistance reducing unit 13 can be fabricated in a certain shape and coupled at one side of the annular bar body 11 of the rotor 10 by using a bolt, or can be formed by being integrally molded at a lower portion of the annular bar body 11.

The refrigerant flow resistance reducing unit 13 is made of a resin or a metal according to characteristics of a refrigerant gas used in the compressor.

The compression mechanism unit includes a cylinder assembly (D) having an inner space (V), a suction passage (f1) and a discharge passage (f2) communicating with the inner space and fixedly coupled at an inner wall of the hermetic container 1 spaced apart from the electric mechanism unit, and a rotational shaft 20 coupled to penetrating the center of the inner space (V) of the cylinder assembly (D).

One side of the rotational shaft 20 is coupled by being press-fit into the axial coupling hole 12 of the rotor 10 of the electric mechanism unit.

The cylinder assembly (D) includes a cylinder 30 having a through hole, and an upper bearing plate 40 and a lower bearing plate 50, respectively, coupled to cover an upper surface and a lower surface of the cylinder 30 to thereby form the inner space (V) together with the cylinder 30 and supporting the rotational shaft 20.

The rotational shaft 20 includes an axial portion 21 with a predetermined outer diameter and length inserted into axial insertion holes 43 and 53 respectively formed at the upper bearing plate 40 and the lower bearing plate 50, and a dividing plate 22 extendedly formed at one side of the axial portion 21 to section the inner space (V) of the cylinder assembly (D) into first and second spaces V1 and V2.

The dividing plate 22 of the rotational shaft 20, formed as a wave curved surface in a sine wave shape, includes an upper convex curved portion r1 formed with a convex surface in view of side section, a lower concave curved portion r2 formed with a concave surface, and a connection curved portion r3 connecting the convex curved portion r1 and the concave curved portion r2.

One side portion of the rotational shaft 20 is coupled by being press-fit into the axial coupling hole 12 of the rotor 10.

A vane 70 is inserted into a vane slot 44 formed at one side of the upper bearing plate 40 and a vane slot 54 formed at one side of the lower bearing plate 50, and an elastic support unit 80 supporting the vane 70 is coupled at the upper bearing plate 40 and the lower bearing plate 50.

An opening and closing unit 90 is coupled at the cylinder assembly (D) to discharge a gas compressed in the compression areas $V1_b$ and $V2_b$ of the first and second spaces V1 and V2 by opening and closing the discharge passage f2, and a suction pipe 100 is coupled to the hermetic container 10 in a manner of communicating with the suction passage f1.

A discharge hole 4 is coupled at the hermetic container 1 so as to be positioned at an upper side (in view of the drawing) of the stator 2 and the rotor 10.

Reference numeral 110 denotes a noise muffler.

The operational effect of the structure for reducing a refrigerant flow loss of the compressor of the present invention will now be described.

First, when power is applied to the electric mechanism unit (M), the rotor 10 is rotated by the interaction between the stator 2 and the rotor 10 of the electric mechanism unit. The rotational force of the rotor 10 is transferred to the rotational shaft 20 coupled at the rotor 10 and the rotational shaft 20 is rotated. Then, the dividing plate 22 of the rotational shaft 20 is rotated in the inner space (V) of the cylinder assembly (D).

As the dividing plate 22 of the rotational shaft 20 is rotated in the inner space (V) of the cylinder assembly (D), vanes 70 being in contact with the dividing plate 22 interwork to change the first space V1 and the second space V2 to suction areas V1*a* and V2*a* and compression areas V1*b* and V2*b*, and with the opening and closing unit 90 operating, a refrigerant gas is sucked into the first and second spaces V1 and V2, compressed and discharged. This process is repeatedly performed.

The high temperature and high pressure refrigerant gas discharged from the compression mechanism unit into the internal space of the hermetic container flows to the gap (G) between the rotor 3 and the stator 2 and the gas passage formed between an outer circumferential surface of the stator 2 and an inner circumferential surface of the hermetic container 1 and is discharged outwardly of the hermetic container 1 through the discharge pipe 4.

In the above process, since the refrigerant flow resistance reducing unit 13 is provided at the rotor 10 of the electric mechanism unit which is positioned at the upper side of the compression mechanism unit to guide flowing of the refrigerant, as shown in FIG. 8, when the refrigerant discharged from the compression mechanism unit is introduced into the stator 2 and the rotor 10, the refrigerant flow resistance can be reduced.

In other words, the refrigerant gas discharged from the first and second spaces V1 and V2 of the cylinder assembly (D) of the compression mechanism unit is discharged through the hole (not shown) formed in the noise muffler 110 after passing the noise muffler 110, and the refrigerant gas discharged through the noise muffler 110 is guided through the refrigerant flow resistance reducing unit 13 of the rotor 10 positioned at the upper side of the noise muffler 110 and flows through the gap (G) between the rotor 10 and the stator 2. Therefore, the flow resistance of the refrigerant can be reduced and the refrigerant gas can flow smoothly.

Meanwhile, the structure for reducing a refrigerant flow loss in a compressor in accordance with the present invention also can be adopted to an electric mechanism unit of the rotary compressor which works in such a manner that a rotational shaft is rotated upon receiving a driving force of the electric mechanism unit, a rolling piston inserted into an eccentric portion of the rotational shaft is rotated in a compression space of a cylinder according to the rotation of the rotational shaft, to thereby change the compression space of the cylinder to a suction area and a compression area together with a vane being in contact with the eccentric portion, thereby compressing a refrigerant gas.

As so far described, the structure for reducing a refrigerant flow loss in a compressor in accordance with the present invention has the following advantages.

That is, when the high temperature and high pressure refrigerant gas discharged from the compression mechanism unit flows to the discharge pipe through the refrigerant passage including the gap between the rotor and the stator of the electric mechanism unit, the flow resistance of the refrigerant gas is reduced. Therefore, since the refrigerant can flow smoothly, a flow loss of the refrigerant can be reduced and, as a noise generation is reduced, a reliability can be heightened.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A structure for reducing a refrigerant flow loss in a compressor having a stator fixedly coupled inside a container and a rotor rotatably inserted into the stator with a space therebetween, and a compression mechanism unit having a rotational shaft coupled to the rotor for compressing a gas and discharging a compressed gas, said structure comprising a refrigerant channel resistance reducing unit for reducing a refrigerant channel resistance caused by the rotor, wherein the refrigerant channel resistance reducing unit comprises at least one curved surface configured to channel the compressed gas discharged from the compression mechanism unit into the space between the rotor and the stator.

2. The structure of claim 1, wherein the refrigerant channel resistance reducing unit comprises:

an edge convex curved face formed curved at an edge of an annular bar body of the rotor; and an inner concave curved face formed at a corner between a surface of the annular bar body of the rotor and the rotational shaft coupled at the annular bar body of the rotor.

3. The structure of claim 2, wherein the refrigerant channel resistance reducing unit is coupled by an engaging unit to the annular bar body of the rotor.

4. The structure of claim 2, wherein the refrigerant channel resistance reducing unit is integrally formed on the annular bar body.

5. The structure of claim 1, wherein the refrigerant channel resistance reducing unit comprises a resin.

6. The structure of claim 1, wherein the refrigerant channel resistance reducing unit comprises a metal according to characteristics of the gas used in the compressor.

7. A compressor comprising the refrigerant channel resistance reducing unit of claim 1.

8. A structure for reducing a refrigerant flow loss in a compressor having a stator fixedly coupled inside a container and a rotor rotatably inserted into the stator with a space therebetween, and a compression mechanism unit having a rotational shaft coupled to the rotor for compressing a gas and discharging a compressed gas, said structure comprising a refrigerant channel resistance reducing unit for reducing a refrigerant channel resistance caused by the rotor, wherein the refrigerant channel resistance reducing unit is formed as a convex curved face from an edge of the rotor at the space between the rotor and the stator to an edge line of the rotor at an axial coupling hole penetratingly formed at a centerline of the rotor, into which the rotational shaft is coupled.

9. The structure of claim 8, wherein the refrigerant channel resistance reducing unit is coupled to the rotor by an engaging unit.

10. The structure of claim 8, wherein the refrigerant channel resistance reducing unit is integrally formed on the rotor by molding.

11. The structure of claim 8, wherein the refrigerant channel resistance reducing unit comprises a resin according to characteristics of a refrigerant gas used in the compressor.

12. The structure of claim 8, wherein the refrigerant channel resistance reducing unit comprises a metal.

13. A compressor comprising the refrigerant channel resistance reducing unit of claim 8.

14. A compressor having an internal gas passageway, comprising:

a housing;

a compressor mechanism mounted to the housing;

a stator mounted to the housing;

a rotor that is rotationally mounted within the stator, wherein the rotor is coupled to the compressor mechanism and configured to drive the compressor mechanism; and a flow guide provided on the rotor, wherein the flow guide is configured to guide a flow of compressed gas into a flow passage formed between the rotor and the stator, and wherein the flow guide comprises at least one curved surface that acts to reduce a flow resistance of the compressed gas.

15. The apparatus of claim 14, wherein the at least one curved surface comprises a concave surface located adjacent a central hole of the rotor used to mount the rotor on a shaft.

16. The apparatus of claim 15, wherein the at least one curved surface further comprises a convex curved surface located at an outer annular edge of the rotor.

17. The apparatus of claim 14, wherein the at least one curved surface comprises a convex curved surface located at an outer annular edge of the rotor.

18. The apparatus of claim 14, wherein the at least one curved surface comprises a convex surface that extends between a central hole of the rotor used to mount the rotor on a shaft and an outer annular edge of the rotor.

19. The apparatus of claim 14, wherein the flow guide is also configured to reduce a noise produced by the flow of compressed gas.

* * * * *